US006923134B1

(12) United States Patent
Vrudny et al.

(10) Patent No.: US 6,923,134 B1
(45) Date of Patent: Aug. 2, 2005

(54) HINGED WIREWAY FOR PERSONAL WATERCRAFT

(75) Inventors: Michael G. Vrudny, Spirit Lake, IA (US); Darin R. Packebush, Spirit Lake, IA (US); Jeffrey L. Gardner, Spirit Lake, IA (US)

(73) Assignee: Polaris Industries Inc., Medina, MN (US)

( * ) Notice: Subject to any disclaimer, the term of this patent is extended or adjusted under 35 U.S.C. 154(b) by 70 days.

(21) Appl. No.: 10/313,716

(22) Filed: Dec. 6, 2002

(51) Int. Cl.[7] ..... B63B 19/00
(52) U.S. Cl. ..... 114/55.53; 114/343; 114/364
(58) Field of Search ..... 114/55.5, 55.53, 114/343, 361, 364, 201 R; 440/1; 296/76; 180/69.2–69.24; 16/221

(56) References Cited

U.S. PATENT DOCUMENTS

| | | | | |
|---|---|---|---|---|
| 2,672,500 | A * | 3/1954 | Bondon | 174/153 R |
| 3,896,404 | A * | 7/1975 | Peterson | 335/205 |
| 4,143,436 | A * | 3/1979 | Jones | 114/363 |
| 4,226,432 | A * | 10/1980 | Nakamizo | 174/152 G |
| 4,941,854 | A | 7/1990 | Takahashi et al. | |
| 5,507,672 | A * | 4/1996 | Imaeda | 440/1 |
| 5,831,217 | A * | 11/1998 | Jarvis et al. | 174/153 R |
| 5,894,810 | A * | 4/1999 | Orr | 114/343 |
| 6,276,290 | B1 | 8/2001 | Yamada et al. | |
| 6,308,650 | B1 | 10/2001 | Tsumiyama et al. | |
| 6,595,811 | B2 * | 7/2003 | Dagenais et al. | 440/1 |
| 2001/0000052 | A1 | 3/2001 | Yamada et al. | |
| 2002/0007774 | A1 * | 1/2002 | Madachi et al. | 114/144 R |
| 2002/0053310 | A1 | 5/2002 | Ibata et al. | |
| 2002/0077007 | A1 | 6/2002 | Dagenais et al. | |

FOREIGN PATENT DOCUMENTS

| | | | | |
|---|---|---|---|---|
| JP | 04314687 A | * | 11/1992 | B63B 9/06 |
| JP | 06227483 A | * | 8/1994 | B63B 35/73 |
| JP | 11043091 A | * | 2/1999 | B63B 35/73 |
| JP | 2000225989 A | * | 8/2000 | B63B 29/04 |

* cited by examiner

*Primary Examiner*—S. Joseph Morano
*Assistant Examiner*—Ajay Vasudeva
(74) *Attorney, Agent, or Firm*—Fredrikson & Byron, P.A.

(57) ABSTRACT

A hinge assembly for mounting to a jet propelled personal watercraft including a hinge and a wire bundle assembly. The hinge can include a hinge top portion for mounting to the personal watercraft hood pivotally coupled to a hinge bottom portion for mounting to the top deck. The hinge bottom portion can have a wireway aperture therethrough. The wire bundle assembly can include several wires disposed within a tube, in turn disposed within a seal formed about the tube. The tube seal can be at least partially received within the hinge bottom portion aperture. The tube seal is preferably forced downward by the hinge bottom portion against the top deck. The wire bundle assembly can be formed as an assembly at a site distinct from the site of final watercraft manufacture. The wire bundle assembly can be inserted through the top deck, and secured in place by the hinge being secured to the top deck, over the inserted wire bundle assembly. The hinge assembly provides an easy to assemble and very watertight seal about the wire bundle extending from beneath the top deck to any electrical instruments located on the personal watercraft hood.

32 Claims, 7 Drawing Sheets

HINGED WIREWAY FOR PERSONAL WATERCRAFT

FIELD OF THE INVENTION

The present invention is related generally to personal watercraft. More specifically, the present invention is related to watertight, sealed wireways passing through personal watercraft ducts. The present invention includes a combination wireway seal and hood hinge plate for personal watercraft.

BACKGROUND OF THE INVENTION

Personal watercraft (PWC) have become increasingly popular in recent years. A personal watercraft, also known as a "jet ski" typically has a bottom hull, handle bars for steering, a tunnel within the bottom hull, a jet pump located within the bottom tunnel, and an engine within the hull under the top deck for driving the jet pump. The jet pump typically pulls in water from the front of the tunnel under the boat, and discharges the water at high velocity through a steerable nozzle at the rear of the boat. The handlebars are typically coupled to the nozzle, which is the steering mechanism for the personal watercraft. The watercraft commonly has a straddle-type seat and foot wells disposed on either side of the seat.

Personal watercraft typically have a top deck affixed to a bottom hull. The PWC has a shroud mounted in front of the driver on top of the top deck to house the steering column and some instruments. A front portion of the top deck includes a hinged cover or "hood." The underside of the hood can include a gasket or a grommet that attempts to provide a watertight seal between the hood and the top deck. The hood typically covers either a storage bin or an engine access port.

In previous PWCs, instruments such as speedometers have been mounted in or on the shroud part of the deck, often behind a small windshield that is in front of the driver. The wires for such instruments typically originate from components located within and under the top deck. The wires then extend through the deck to instrument readout devices such as speedometers located on the opposite, top side of the top deck.

Previously, wires that run through the deck have been run through a rubber liner or tube surrounded by an annular grommet. The wires run through the grommet surfaced upwardly within an instrument gauge compartment, which was itself, often watertight. In some PWCs, the instrument was formed integrally with a part of the top deck. In these PWCs, the point of wire passage through the top deck was not a likely source of water entry because the passageway through the deck was not exposed to water.

PWC manufacturers have recently tried to expand the storage bin size under the hood. Hood sizes have therefore increased. This, in turn, has shrunk the shroud area, reducing the space available for instrument placement. For this reason, instrument readout devices are currently being placed on top of the hood, instead of on the shroud.

The hood is hingedly mounted to the personal watercraft top deck at the front, rather than at the rear, as in an automobile. The instrument readout device may be mounted beneath a small windshield on the rear-most portion of the hood, in front of the driver, and well behind the point of hinged mounting. The wires must thus originate from within the top deck and terminate on the outside of the top deck near the rear portion of the upwardly swingable hood at the instrument readout location.

Watercraft manufacturers have passed the wires for the instrument panel and other wires through the top deck, and have made some attempts to provide a watertight passage through the point of wire entry through the top deck. One, typical approach includes the use of a corrugated, rubber or plastic tube. The wires often have hard plastic, rigid plugs or connectors at both ends for connecting to other electrical connectors beneath the top deck and in the instrument panel. These electrical connectors may, for example, have four or more discrete contacts within the rigid electrical plug. During manufacture, a top deck is provided, having a hole for passing the wireway through the top deck. A corrugated, rubber or plastic tube can also be provided, having a slit along its length. The wire bundle can be forced transversely from the outside of the tube, through the slit, sideways into the tube center. This can avoid the problem of trying to drag the large electrical plugs through the narrower tube. A rubber boot or grommet can then be stretched to fit over the electrical plug at one end, and slid over the corrugated tube to form a wire bundle assembly.

This assembly can then be inserted through the hole in the top deck, with the boot or grommet resiliently deformed to sit astride the top deck layer, typically having a flange on both the top side of the top deck and the underside of the top deck. The wires or multiwire bundles typically have a round shape, there being multiple round shapes extending through a larger, nominally round, slit, corrugated tube. This geometry lends itself toward water leakage as two, or three round shapes disposed within a larger round shape leave a void area. To address this leakage problem, zip ties are often put around the outer corrugated tube above and below the rubber grommet and tightened, in an attempt to make the wire passage through the grommet watertight.

This approach has proved less than satisfactory. The lengthwise slit through the tube provides a point of entry for water into the top portion of the tube, above the zip tie. The zip tie itself often does not provide a watertight seal between the outer corrugated tube and the inner wire or wire bundles. There is often some space between the outer rubber grommet and the corrugated rubber tube. The end of the corrugated rubber tube is typically open. As this provides another point of entry for water, some manufacturers have attempted to plug the upper end of the corrugated tube with a specially designed plug in an attempt to plug the corrugated tube while providing specially shaped apertures for passing the wires or wire bundles through the plug. This plug can become dislodged, or not replaced after being taken out, and in any case, does not prevent water entry along the length of the slit.

The position of the wireway passage through the top deck also presents a problem. The opening and closing of the hood, with the wires typically being run, at some point, under the hood, requires that there be a sufficient amount of slack in the wires to allow for opening the hood. The added length of wire or wire tubing can be undressed wire, which can present a length of wire or tubing that can become snagged, cracked, and otherwise fatigued.

What would be desirable is a system for providing a watertight seal for running wires through the top deck of a personal watercraft. What would be advantageous is an easier to manufacture wireway for extending through the top deck of a personal watercraft. A wireway seal that was actually watertight and that did not require the current length of slack in order to allow for hood opening would be most advantageous. Easier to manufacture systems for installing wireways through personal watercraft top decks would also be advantageous.

SUMMARY OF THE INVENTION

The present invention provides a jet propelled personal watercraft including a hull, the hull having a bottom hull and a top deck secured over the bottom hull, the hull defining an engine compartment sized to contain an internal combustion engine for powering a jet propulsion unit. The personal watercraft also includes a jet propulsion unit including a steerable water discharge nozzle. The top deck can have a raised, longitudinally extending seat adapted to accommodate an operator in straddle fashion. The personal watercraft further includes a hood having at least one electrical instrument disposed on a rear portion of the hood in front of the driver. The personal watercraft also includes a hinge assembly comprising a hinge having a hinge top portion for mounting to the hood and a hinge bottom portion for mounting to the top deck. The hinge bottom portion can be pivotally coupled to the hinge top portion about a hinge pivot, with the hinge bottom portion also having a wireway aperture therethrough. The hinge assembly can further include a wire bundle assembly including a plurality of wires disposed within a tube disposed within a seal formed about the tube. The tube seal can be at least partially received within the hinge bottom portion aperture. At least some of the wires are preferably coupled to the electrical instrument.

In one embodiment, the tube seal is forced downward by the hinge bottom portion against the top deck. The seal about the tube preferably has a top portion having a top maximum dimension and a bottom portion having a bottom maximum dimension, wherein the seal top maximum dimension is less than the seal bottom maximum dimension. Correspondingly, the hinge bottom portion aperture preferably has a top opening smaller than the aperture bottom opening, such that at least part of the hinge bottom portion near the aperture forces downwardly against at least part of the seal. In some embodiments, the seal has a stepped transition between the seal top and the seal bottom. The seal can be formed of a polymeric material about the wire tube, preferably a rubber material. The seal can be integrally formed about the wire tube. The hinge aperture is preferably located within about one foot of the hinge pivot. The tube is preferably substantially contiguous about its circumference, preferably having no longitudinal slit along a majority of its length.

A preferred hinge wireway includes a radially constricted portion of the tube in the vicinity of the wireway aperture. In this embodiment, the tube portion located within the seal is radially constricted about the wires within the tube in the vicinity of the seal, to form a water resistant passage within the tube in the vicinity of the seal. The wire bundle assembly can further include at least one electrical connector coupled to at least one of the wires within the bundle. The electrical connector can have a maximum dimension greater than the tube maximum outer dimension.

The present invention also provides a hinge assembly for mounting to a jet propelled personal watercraft. The hinge assembly can include a hinge having a hinge top portion for mounting to the hood and a hinge bottom portion for mounting to the top deck, pivotally coupled to the hinge top portion about a hinge pivot. The hinge bottom portion preferably has a wireway aperture therethrough. The hinge assembly can also include a wire bundle assembly several wires disposed within a tube. The tube can be disposed within a seal formed about the tube, with the tube seal at least partially received within the hinge bottom portion aperture. In a preferred hinge assembly, the tube seal is forced downward by the hinge bottom portion against the top deck when the hinge assembly is put in place. The hinge assembly wireway aperture also preferably has a top opening sized smaller than the bottom opening, corresponding to a seal having a top portion smaller than the seal bottom portion. When the hinge bottom portion is forced against the seal, at least a part of the hinge bottom portion forces downwardly against at least part of the seal. Some hinge assemblies have a stepped transition from top to bottom, corresponding to a stepped transition between the seal top and bottom. The hinge assembly also preferably includes a tube portion located within the seal that is radially constricted about the wires within the tube in the vicinity of the seal, to form a water resistant passage within the wire tube in the vicinity of the seal.

The present invention provides a wire bundle assembly that can be manufactured efficiently, at a site distinct from the site of final watercraft assembly. The wire bundle assembly can be manufactured to have a watertight, rubber tube formed about several electrical wires, not requiring a longitudinal slit along the tube length in order to insert the wires. Electrical connectors can be coupled to each end of the wires extending through the wire tube, without regard for the electrical connector size relative to the seal or grommet to be disposed over the wire tube. The seal can be integrally formed about the wire tube, after the wires have been inserted through the tube, and even after the electrical connectors have been put in place. The seal can be formed by disposing the tube carrying the electrical wires within an injection-molding machine, and injection molding a polymeric, rubber material about the tube, to form a seal about the tube. In some embodiments, the seal is integrally formed with the tube. In a preferred embodiment, the molding process also compresses the tube about the wires in the vicinity of the seal, to form a water resistant, radially constrained wire tube in the vicinity of the seal.

The finished wire bundle assembly can have the bottom electrical connector inserted through an aperture in the personal watercraft top deck, and the top electrical connector inserted through the hinge aperture. The hinge bottom plate can simply be slid down over the tube, to force the seal against the top deck, between the top deck and the hinge bottom plate, to form a watertight seal. The hinge can be secured to the personal watercraft top deck, thereby both securing the hinge and forming the watertight seal in a single, final manufacturing operation. This operation requires only a single set of holes formed through the personal watercraft top deck, for the hinged wireway.

The aperture through the top deck can thus be located very close to the hinge point for the hood, as the aperture is formed through a portion of the hinge itself. This close location of the wireway aperture to the hinge allows for a smaller amount of slack required for the wire bundle in the vicinity of the hood. The wire bundle can thus be more closely dressed to the hood, leaving less wire tubing to be snagged or otherwise undesirably engaged.

DETAILED DESCRIPTION OF THE PREFERRED EMBODIMENTS

The following detailed description should be read with reference to the drawings, in which like elements in different drawings are numbered identically. The drawings, which are not necessarily to scale, depict selected embodiments and are not intended to limit the scope of the invention. Several forms of invention have been shown and described, and other forms will now be apparent to those skilled in art. It will be understood that embodiments shown in drawings and described above are merely for illustrative purposes, and are not intended to limit scope of the invention as defined in the claims that follow.

Figure 1:
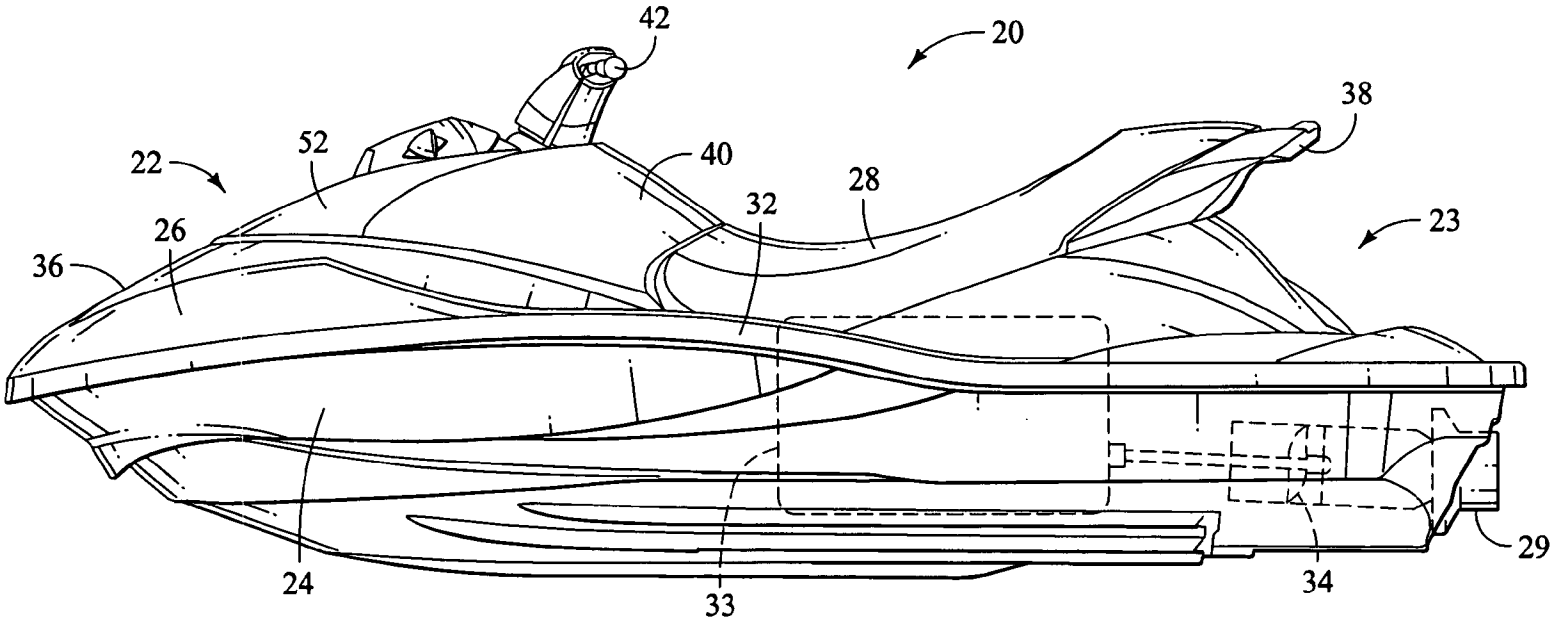
FIG. 1 is a side view of a personal watercraft having a hinged wireway within.

FIG. 1 illustrates a personal watercraft 20 having generally a front or bow 22 and a rear or stern 23. Personal watercraft 20 includes a top deck 26 secured to a bottom hull 24 along an overlapping portion covered with a rub rail 32 in the embodiment illustrated, forming a hull. A hood 52 may also be seen, joined to top deck 26 at a hinged front hood portion 36. The hull formed by the bottom hull 24 and top deck 26 define a compartment sized to contain an internal combustion engine 33 for powering the watercraft, and may also include one or more storage compartments, depending upon the size and configuration of the watercraft. The deck portion 26 also has a raised, longitudinally extending seat 28 adapted to accommodate one or more riders seated in straddle fashion on the seat 28. A grab handle 38 is disposed transversely across the rear of the seat. Engine 33 powers a jet propulsion unit 34, typically mounted in a tunnel at the bottom rear portion of the watercraft, all shown in phantom in FIG. 1. Jet propulsion unit 34 includes a steerable water discharge nozzle 29 that is operatively connected to a set of handlebars 42 to facilitate steering of the watercraft by the operator. Handlebars 42 typically mount through a top portion of a shroud 40. The connection between handlebars 42 and discharge nozzle 29 may be of any suitable type, and typically includes mechanical linkages including a control cable. If desired, an electronic connection could also be utilized.

Figure 2:
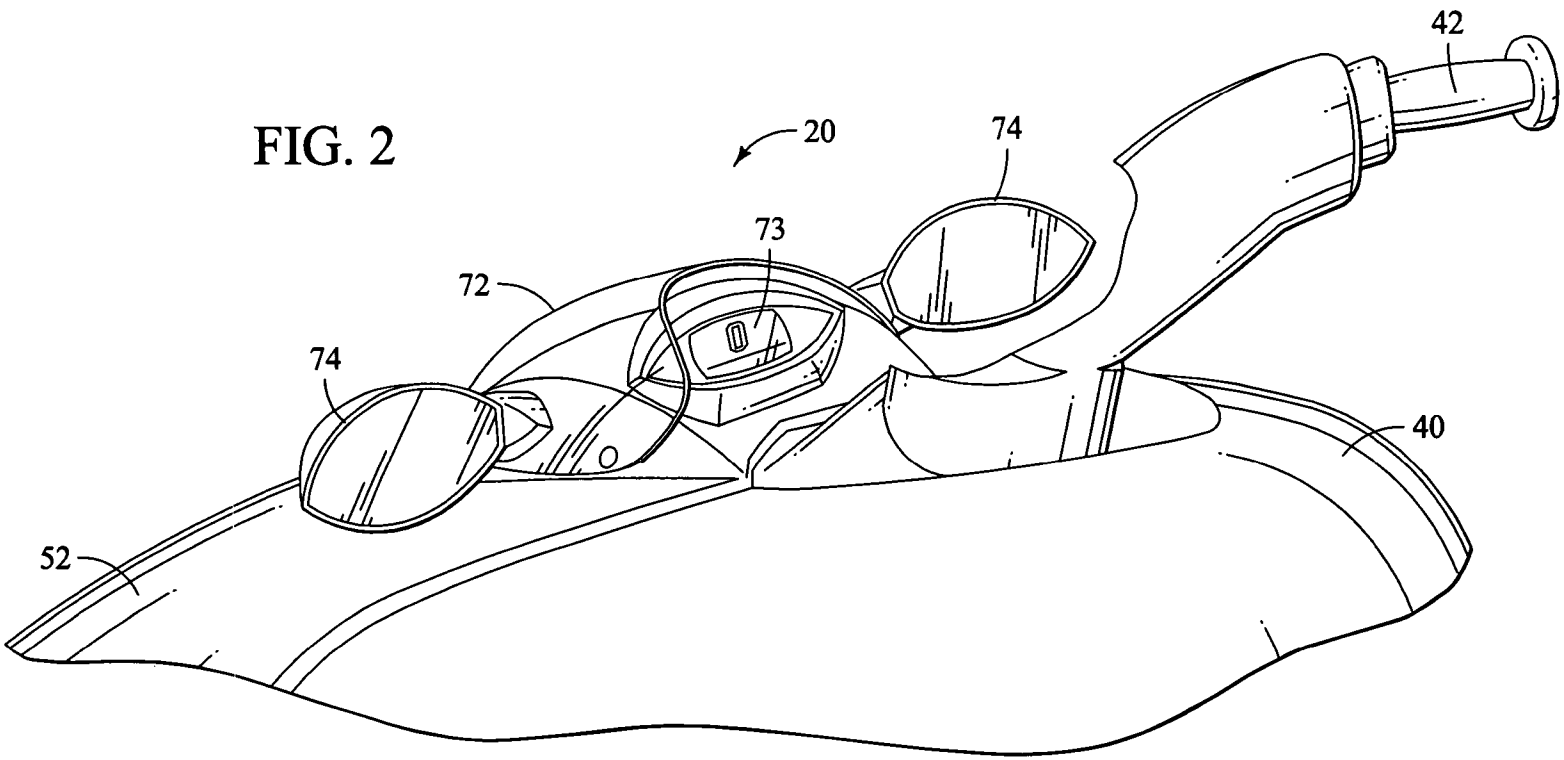
FIG. 2 is a fragmentary, perspective view of an instrument panel on the personal watercraft of FIG. 1, located on the hood of the personal watercraft.

FIG. 2 illustrates personal watercraft 20 from the side and to the rear of handlebars 42. Twin rearview mirrors 74 may be seen, as may an instrument panel or gauge 73, mounted on hood 52. An instrument windscreen 72 may be seen partially covering instrument panel 73. A wire bundle or tube (not illustrated in FIG. 2) is connected to instrument panel 73 and extends downward through hood 52 to run forward under hood 52.

Figure 3:
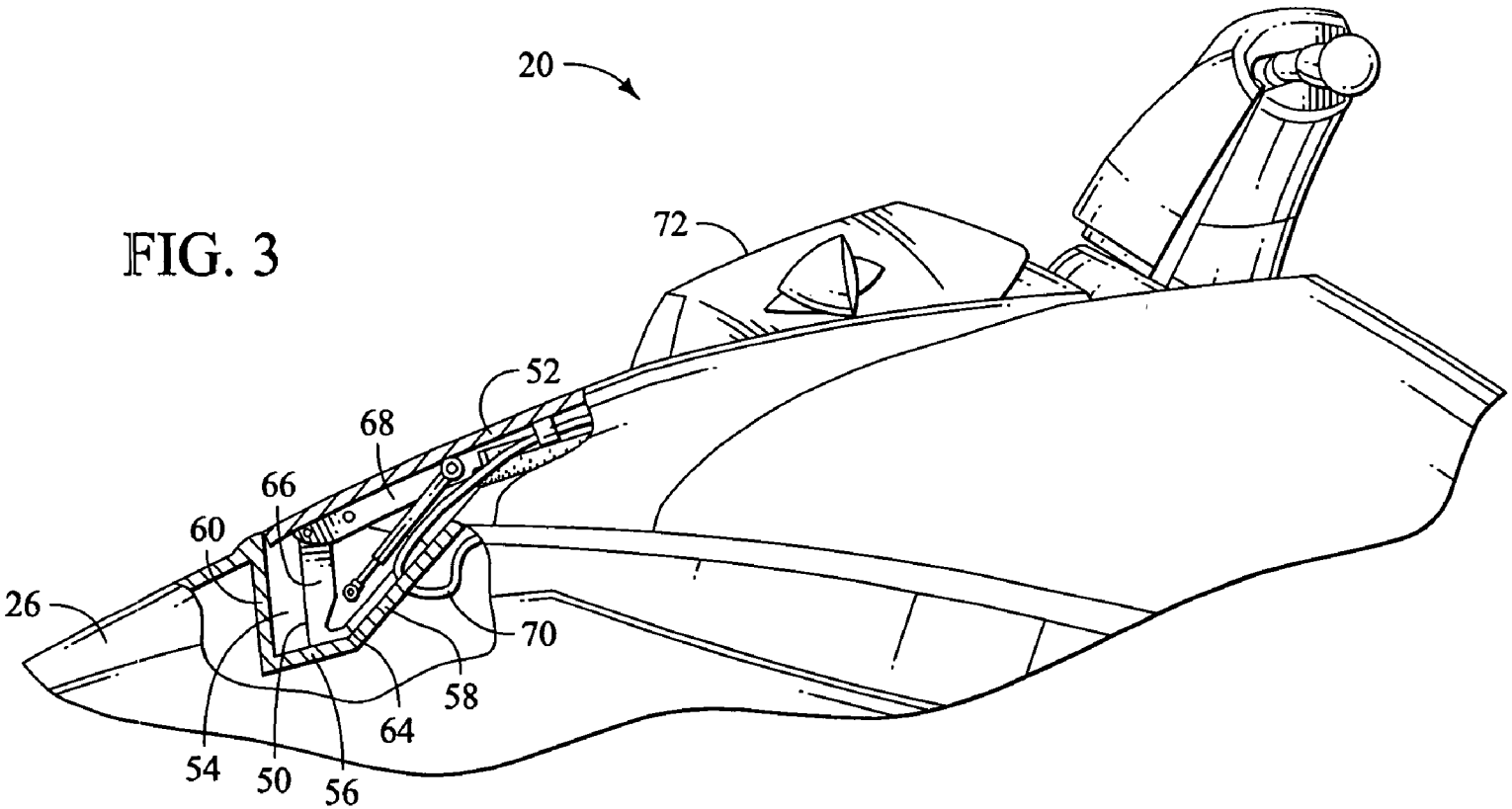
FIG. 3 is a fragmentary, side, cross-sectional view of the personal watercraft of FIG. 1, showing the hinged wireway and hood.

FIG. 3 illustrates personal watercraft 20, more fully illustrating hood 52. Hood 52 may be seen affixed to a hinged wireway assembly 50. Hinged wireway assembly 50 includes a top portion 68 and a bottom portion 64. A front region 66 may be seen extending between bottom portion 64 and top portion 68. Front region 66 of bottom portion 64 is pivotally coupled to hinged wireway top portion 68. Hinged wireway bottom portion 64 may also be referred to as a bottom plate. A wire tube 70 may be seen extending through hinged wireway bottom plate 64, to extend upward and rearward to connect to instrument panel 73 (illustrated in FIG. 2). Top deck 26 may be seen to include a front wall portion 60, a bottom wall portion 56, and a rear, sloping wall portion 58. Deck portions 60, 56, and 58 may be seen to generally form a cavity 54 that houses hinged wireway 50.

Figure 4:
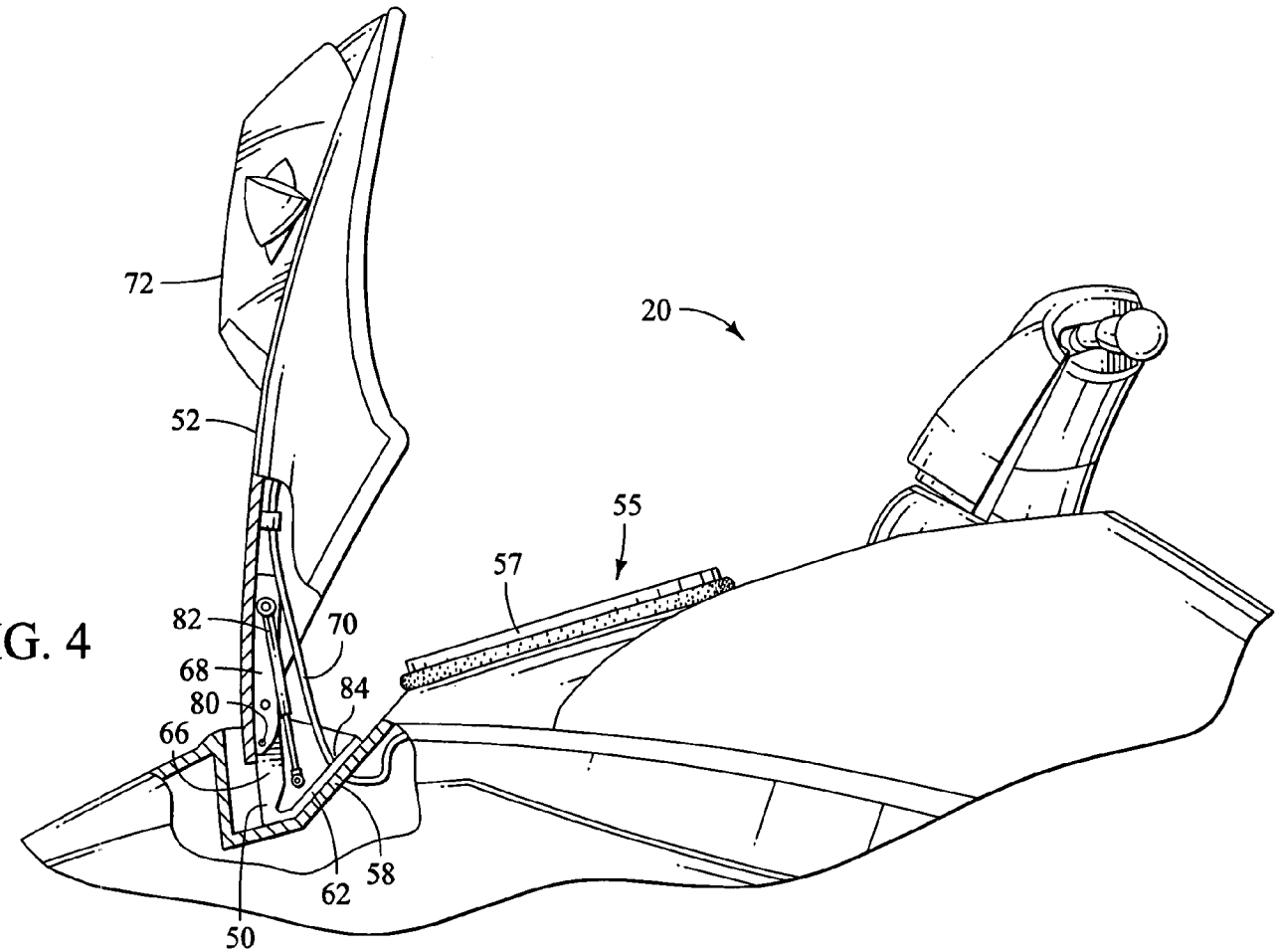
FIG. 4 is a fragmentary, side, cutaway view of the personal watercraft of FIG. 1, having the hood in the raised position.

FIG. 4 illustrates personal watercraft 20, having hinged wireway 50 and hood 52 in the raised, open position. In some embodiments, hood 52 and hinged wireway 50 may be held in the open position with a gas shock 82, as illustrated in FIG. 4. Hinged wireway top portion 68 and front region 66 may be seen to be pivotally coupled about a pivot point 80. Wire tube 70 may be seen to pass through hinged wireway bottom plate 62 at aperture 94 and through the deck at wire pass-through point 114. Wire tube 70 also passes through a corresponding aperture in top deck, rear sloping portion 58. Hood 52 may be seen to close about a rubber seal or gasket 57 that defines an aperture 55 within. A storage compartment is preferably accessed through aperture 55 and maintained in a watertight condition by hood 52 and seal 57.

Figure 5:
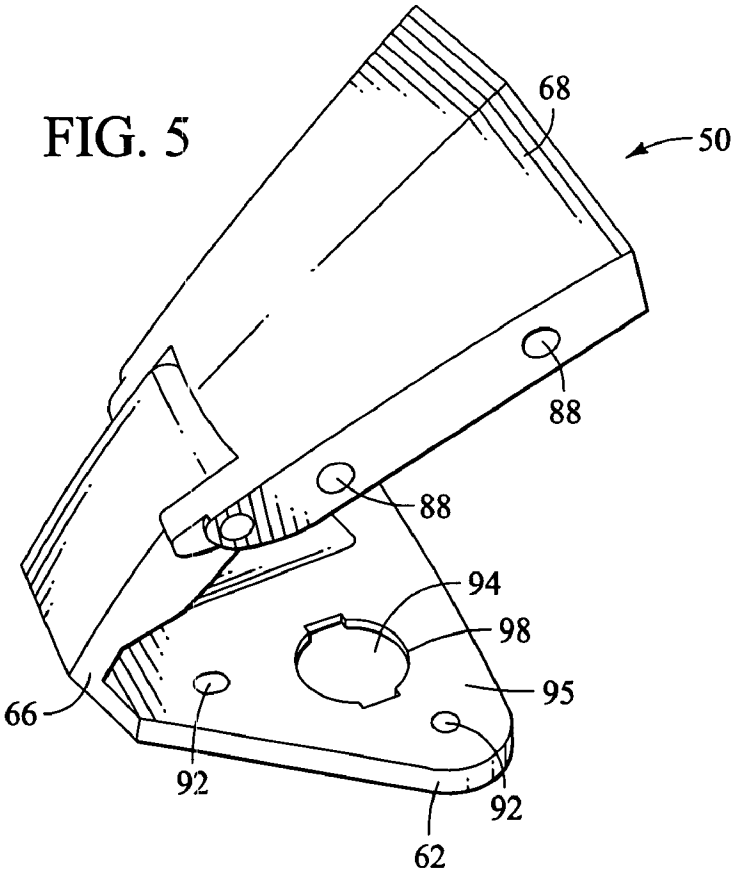
FIG. 5 is a perspective view of the hinged wireway with the wire bundle, wire tubing, seal, and hood not shown.

FIG. 5 illustrates hinged wireway 50, without the hood or wire tube. Hinged wireway 50 may be seen to include mounting holes 88 for mounting to hood 52 (illustrated in FIG. 4). Hinged wireway bottom plate 62 may be seen to have mounting holes 92 for receiving bolts for securing hinged wireway 50 to the personal watercraft top deck. Hinged wireway bottom plate 62 may also be seen to have a wireway or wire tube through-hole or aperture 94 for receiving the wires from beneath the bottom plate, to pass the wires on to the bottom of the hood, and then upward and rearward to the instrument panel. Wireway through-hole 94 may be seen to have a top opening edge 98 defining the size of the top opening. Hinged wireway bottom plate 62 also has a top surface 95, having wireway through-hole top opening 98 formed in the top surface.

Figure 6:
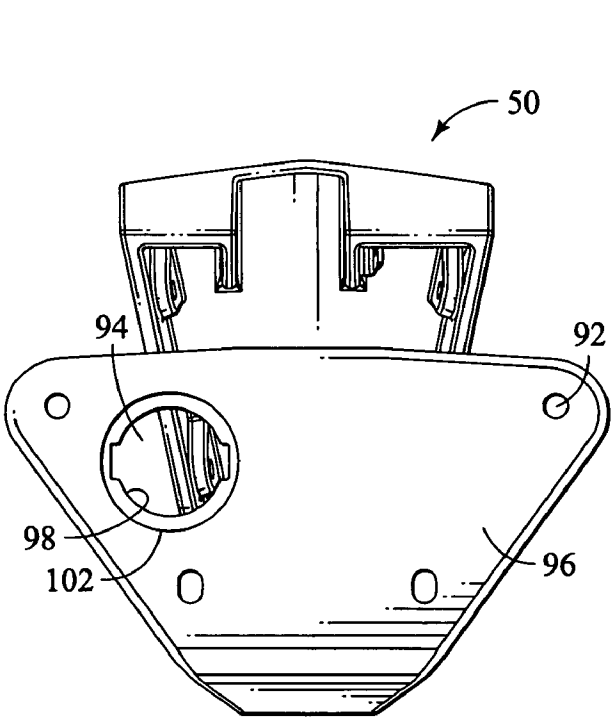
FIG. 6 is a bottom, perspective view of the hinged wireway of FIG. 5, showing a beveled aperture through the hinged wireway bottom plate for receiving the wire tube and seal.

FIG. 6 illustrates hinged wireway 50 from the bottom. Hinged wireway 50 may be seen to have a bottom surface 96 having a bottom opening circumference 102 defining the size of aperture 94 at the bottom surface. Inspection of FIG. 6 shows that the size of top opening 98 is smaller than the size of bottom opening 102. This size difference allows hinged wireway bottom plate 62 to force a wireway seal downward against the top deck. In a preferred embodiment, the transition between top opening 98 and bottom opening 102 is a stepped, beveled transition.

Figure 7:
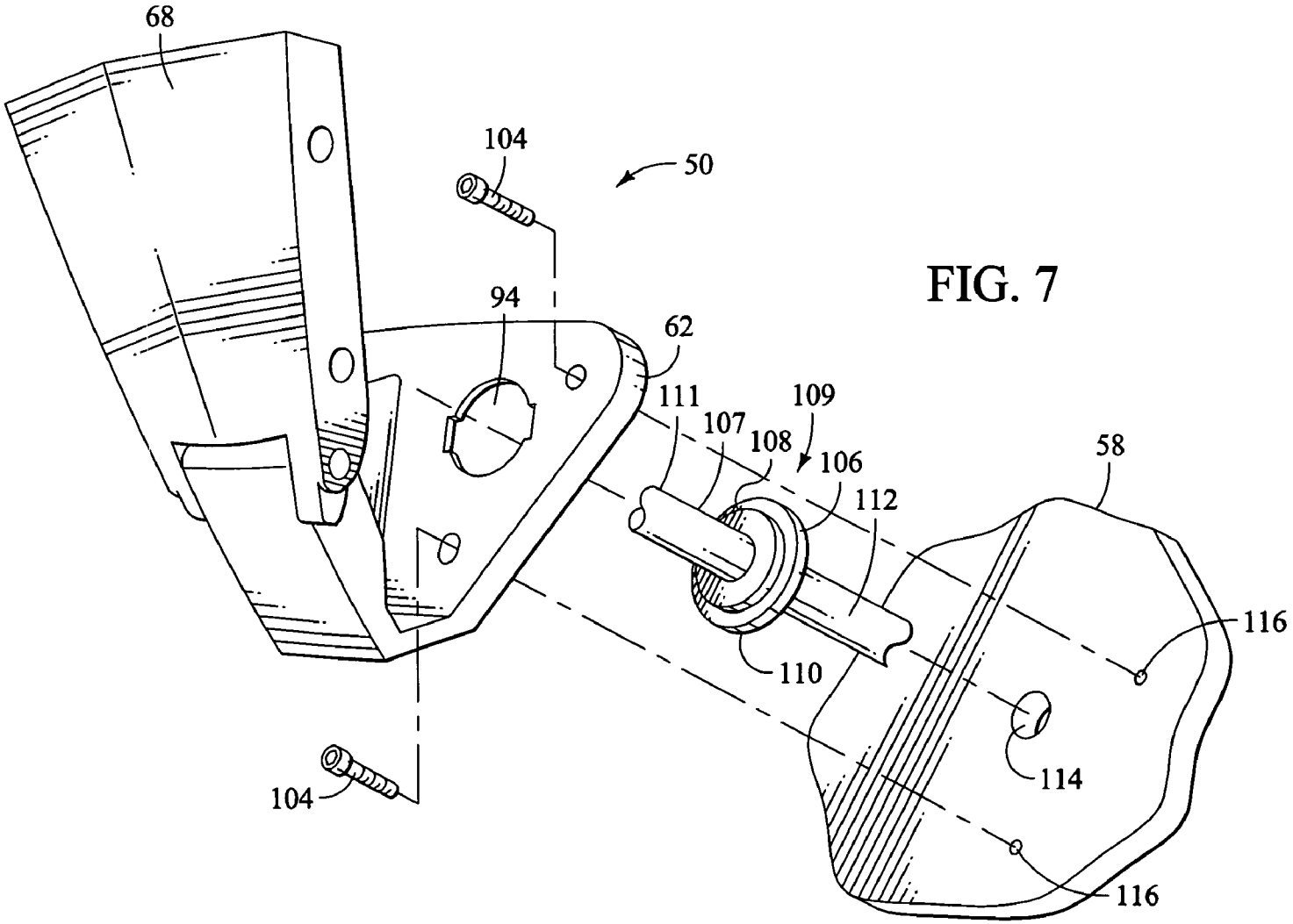
FIG. 7 is a fragmentary, exploded view of the hinged wireway, wire tube and wire tube seal, and the personal watercraft top deck.

FIG. 7 illustrates hinged wireway 50, top deck rear sloping portion 58, and a wire tube assembly 109 to be threaded through the top deck and hinged wireway 50. Wire tube assembly 109 includes a wire tube 107, similar to tube 70, illustrated in FIG. 2. Wire tube 107 includes a wire tube top portion 104 for extending through hinged wireway aperture 94. Wire tube 107 also includes a wire tube bottom portion 112 for inserting through a top deck receiving aperture 114 in top deck rear sloping portion 58.

A wire tube seal, plug, grommet, or boot 106 may be seen formed about wire tube 107. Seal 106 may be seen to have a top portion 108 and a bottom portion 110. In a preferred embodiment, seal top portion 108 has a smaller profile, maximum dimension, and circumference than that of seal bottom portion 110. Seal top portion 108 can be at least partially inserted through hinged wireway bottom plate 62 and seal bottom portion 110 can be seated against top deck rear sloping portion 58, about receiving aperture 114. Mounting bolts 104 may be used to secure hinged wireway bottom plate 62 to top deck rear sloping portion 58 through top deck hinged wireway mounting holes 116.

Figure 8:
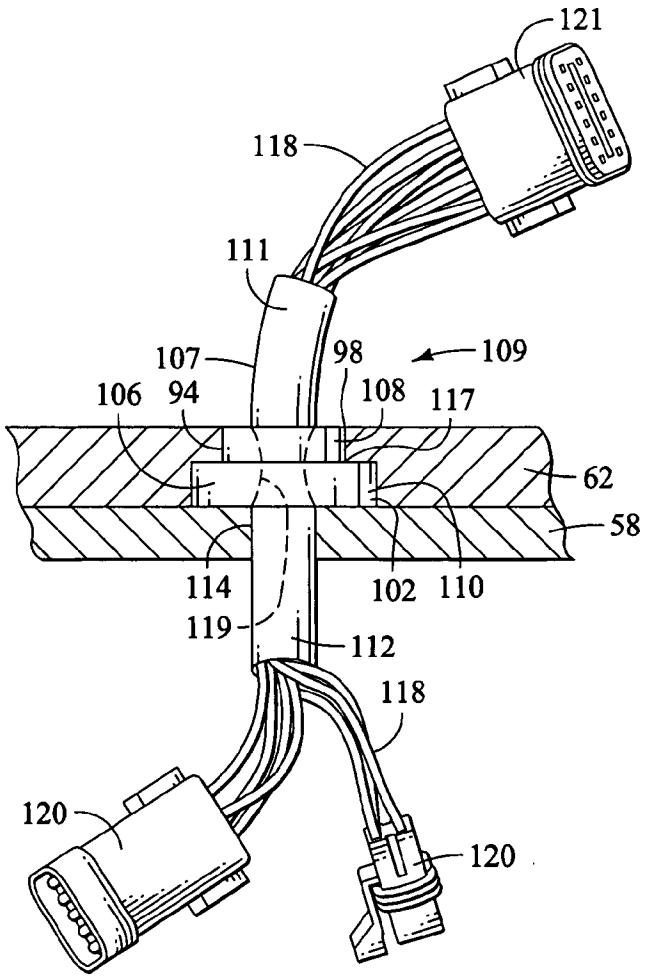
FIG. 8 is a cross-sectional view of the assembly of FIG. 7, showing the wire tube disposed within the beveled seal that is forced downward by the hinged wireway bottom plate against the personal watercraft deck.

FIG. 8 illustrates wire tube assembly 109 in a mounted, sealed configuration. Wire tube top portion 111 has been inserted through hinged wireway bottom plate 62 while wire tube bottom portion 112 has been inserted through top deck wireway through-hole 114. Seal 106 may be seen to be held securely between hinged wireway bottom plate 62 and top deck rear portion 58. Seal top portion 108 may be seen extending through hinged wireway bottom plate 62, through top opening 98. Seal bottom portion 110 may be seen extending through bottom plate, bottom opening 102. Seal 106 may be seen to have a stepped, beveled transition 117, in the embodiment illustrated. Hinged wireway bottom plate 62 may be seen to force seal 106 downward against top deck rear sloping portion 58, while allowing no direct path for water to flow along the wireway tube or seal. Wire tube 107 may be seen to include a top electrical connector 121 and bottom electrical connectors 120. A plurality of wires 118 may be seen within wire tube 107. Connectors 120 and 121 may be seen to be substantially larger than the outer diameter of wire tube 107.

Wire tube 107 may be formed by taking a bundle of wires, and sliding a tube over the bundle of wires. The tube is preferably made of a polymeric material. Most preferably, the tube is an elastomeric, rubber material. The tube preferably has no longitudinal slits or other slits formed through the tube, providing a more water resistant surface. With the polymeric tube formed over the wires, electrical connectors 120 and 121 can be electrically coupled or crimped to the wires within. With the tube material and connectors in place, the entire assembly 109 can be inserted within an injection molding machine.

An injection molding cavity corresponding to the desired shape of seal 106 can be provided to form the desired shape of seal 106. A seal material, preferably a polymeric material, and most preferably a rubber material, can then be injected into the cavity to form seal 106 about wire tube 107. In some embodiments, the seal thus formed about the wire tube is, for all practical purposes, integrally formed with the wire tube, and cannot be dislodged. In other embodiments, seal 106 is formed about wire tube 107, but can be slidably dislodged along the tube with the sufficient application of force. In a preferred application, wire tube 107 is compressed by the molding process to form a smaller diameter tube, as indicated at 119 in FIG. 8. Wire tube 107 thus has a smaller diameter, formed tightly about the wires 118 extending through the tube, within seal 106. This significantly reduces the possibility of any water, which has entered tube 107, from extending through the center of the tube and reaching beneath the top deck.

The above-described process for manufacturing the wire tube, together with electrical connectors and seal, is preferably performed at a location different from the location of the final watercraft assembly. It may be appreciated that the facilities and equipment used to form the final wire tube assembly, including the electrical connectors and seal, may be better provided at a specialized manufacturing facility. The wire tube assembly 109 illustrated in FIG. 8 may be contrasted with some previous assembly methods. Wire tube 107 has no longitudinal slit through the tube, which could allow for water entry and which may have been required for transversely sliding a bundle of wires within the tube. Electrical connectors 120 and 121 illustrated in FIG. 8 can be either larger or smaller than the inside diameter of wire tube 107. Wire tube 107 does not necessarily have to be cinched or compressed above or below seal 106, as the wire tube 107 can be compressed within the seal using the molding process previously described.

Referring again to FIG. 7, assembly of the watercraft may be further described. Given top deck portion 58 having aperture or through-hole 114, the wire tube bottom 112 and the wire tube bottom electrical connector 120 (illustrated in FIG. 8) can be inserted through hole 114. Seal bottom portion 110 is preferably larger than aperture 114 and also larger than the largest dimension of electrical connectors 120. Wire tube upper portion 111 and wire tube upper electrical connector 121 can be inserted through hinged wireway bottom plate 62 through aperture 94. Mounting bolts 104 can then be inserted through hinged wireway bottom plate 62 and further through top deck mounting holes 116. The entire assembly of the hinged wireway, wire tube assembly, and the top deck can thus be accomplished in the same manufacturing operation.

Inspection of FIG. 4 shows that wire tube 70 requires very little slack or extra tubing to allow for the opening of the hood. This is because wire tube 70 is located within hinged wireway 50, rather than being located to the rear of, and separate from, hinged wireway 50. In particular, hinged wireway through-hole 94 may be seen to be relatively close to pivot point 80 of hinged wireway 50. In a preferred embodiment, hinged wireway through-hole 94 is within about one foot of hinged wireway pivot 80. In a preferred embodiment, hinged wireway through-hole 94 is within about 8 inches of hinged wireway pivot 80, to significantly reduce the amount of loose wire tubing that must be allowed to lie within the hood to allow for the opening of the hood.

In another embodiment, the wire tube assembly is secured against the top deck using a plate that is separate from the hinge bottom plate. This embodiment can be similar in other aspects to those aspects previously described for the hinge bottom plate. In particular, bottom plate 62 of FIGS. 5, 6 and 8 may be used to visualize a bottom plate not coupled to a hinge. This embodiment does not therefore require separate, duplicative illustration.

What is claimed is:

1. A jet-propelled personal watercraft comprising:

a hull including a bottom hull and a top deck secured over the bottom hull, the hull defining an engine compartment sized to contain an internal combustion engine for powering a jet propulsion unit, the jet propulsion unit including a steerable water discharge nozzle, the top deck having a raised, longitudinally extending seat adapted to accommodate an operator in straddle fashion;

a hood having at least one electrical instrument disposed on a rear portion of the hood in front of the driver; and a hinge assembly comprising: a hinge having a hinge top portion for mounting to the hood and a hinge bottom portion for mounting to the top deck, the hinge bottom portion being pivotally coupled to the hinge top portion about a hinge pivot, the hinge bottom portion having a wireway aperture therethrough; and a wire bundle assembly including a plurality of wires disposed within a tube disposed within a seal formed about the tube, the tube seal being at least partially received within the hinge bottom portion aperture, and at least some of the wires being coupled to the electrical instrument.

2. A personal watercraft as in claim 1, wherein the tube seal is forced downward by the hinge bottom portion against the top deck.

3. A personal watercraft as in claim 1, wherein the seal has a top having a top maximum dimension and a bottom having a bottom maximum dimension, wherein the seal top maximum dimension is less than the seal bottom maximum dimension and wherein the hinge bottom portion aperture has a top opening smaller than an aperture bottom opening, such that at least part of the hinge bottom portion forces downwardly against at least part of the seal about the aperture.

4. A personal watercraft as in claim 3, wherein the seal has a stepped transition between the seal top and the seal bottom.

5. A personal watercraft as in claim 1, wherein the seal is formed of a polymeric material formed about the wire tube.

6. A personal watercraft as in claim 1, wherein the seal is integrally formed about the wire tube.

7. A personal watercraft as in claim 1, wherein the seal is formed of a rubber material formed about the wire tube.

8. A personal watercraft as in claim 1, wherein the hinge aperture is located within about one foot of the hinge pivot.

9. A personal watercraft as in claim 1, wherein the tube is substantially contiguous about its circumference, having no longitudinal slit along most of its length.

10. A personal watercraft as in claim 1, wherein the tube portion located within the seal is radially constricted about the wires within the tube in the vicinity of the seal, to form a water resistant passage within the tube in the vicinity of the seal.

11. A personal watercraft as in claim 1, wherein the wire bundle assembly further comprises at least one electrical connector coupled to at least one of the wires within the bundle, wherein the tube has a maximum outer dimension and wherein the electrical connector has a maximum dimension greater than the tube maximum outer dimension.

12. A personal watercraft as in claim 1, wherein the wire bundle assembly further comprises at least one electrical connector coupled to each end of at least one of the wires within the bundle, wherein the tube has a maximum outer dimension and wherein the electrical connector has a maximum dimension greater than the tube maximum outer dimension.

13. A personal watercraft as in claim 1, wherein the top deck has a top deck aperture for receiving the tube, wherein the tube seal is forced downward by the hinge bottom portion against the top deck, wherein the tube extends through the top deck aperture, and wherein the seal is larger than the top deck aperture and resides above the top deck aperture.

14. A hinge assembly for mounting to a jet-propelled personal watercraft including a hull having a bottom hull and a top deck secured over the bottom hull, the hull defining an engine compartment sized to contain an internal combustion engine for powering a jet propulsion unit, the jet propulsion unit including a steerable water discharge nozzle, the top deck having a raised, longitudinally extending seat adapted to accommodate an operator in straddle fashion, and a hood, the hinge assembly comprising:

a hinge having a hinge top portion for mounting to the hood and a hinge bottom portion for mounting to the top deck pivotally coupled to the hinge top portion about a hinge pivot, the hinge bottom portion having a wireway aperture therethrough; and a wire bundle assembly including a plurality of wires disposed within a tube disposed within a seal formed about the tube, and the tube seal being at least partially received within the hinge bottom portion aperture.

15. A hinge assembly as in claim 14, wherein the tube seal is forced downward by the hinge bottom portion against the top deck.

16. A hinge assembly as in claim 14, wherein the seal has top having a top maximum dimension and a bottom having a maximum dimension, wherein the seal top maximum dimension is less than the seal bottom maximum dimension and wherein the hinge bottom portion aperture has a top opening smaller than an aperture bottom opening, such that at least part of the hinge bottom portion forces downwardly against at least part of the seal.

17. A hinge assembly as in claim 16, wherein the seal has a stepped transition between the seal top and the seal bottom.

18. A hinge assembly as in claim 14, wherein the seal is formed of a polymeric material formed about the wire tube.

19. A hinge assembly as in claim 14, wherein the seal is integrally formed about the wire tube.

20. A hinge assembly as in claim 14, wherein the seal is formed of a rubber material formed about the wire tube.

21. A hinge assembly as in claim 14, wherein the hinge bottom portion aperture is located within about one foot of the hinge pivot.

22. A hinge assembly as in claim 14, wherein the tube is substantially contiguous about its circumference, having no longitudinal slit along most of its length.

23. A hinge assembly as in claim 14, wherein the tube portion located within the seal is radially constricted about the wires within the tube in the vicinity of the seal, to form a water resistant passage within the wire tube in the vicinity of the seal.

24. A hinge assembly as in claim 14, wherein the wire bundle assembly further comprises at least one electrical connector coupled to at least one of the wires within the bundle, wherein the tube has a maximum outer dimension and wherein the electrical connector has a maximum dimension greater than the tube maximum outer dimension.

25. A hinge assembly as in claim 14, wherein the wire bundle assembly further comprises at least one electrical connector coupled to each end of at least one of the wires within the bundle, wherein the tube has a maximum outer dimension and wherein the electrical connector has a maximum dimension greater than the tube maximum outer dimension.

26. A hinge assembly as in claim 14, wherein the top deck has a top deck aperture for receiving the tube, wherein the tube seal is forced downward by the hinge bottom portion against the top deck, wherein the tube extends through the top deck aperture, and wherein the seal is larger than the top deck aperture and resides above the top deck aperture.

27. A jet-propelled personal watercraft comprising:

a hull having a bottom hull and a top deck secured over the bottom hull, the hull defining an engine compartment sized to contain an internal combustion engine for powering a jet propulsion unit, the jet propulsion unit including a steerable water discharge nozzle, the top deck having a raised, longitudinally extending seat adapted to accommodate an operator in straddle fashion; and a plate assembly for mounting to the jet-propelled personal watercraft top deck, the plate assembly comprising: a plate for mounting to the top deck, the plate having a wireway aperture therethrough and a wire bundle assembly including a plurality of wires disposed within a tube disposed within a seal formed about the tube, and the tube seal being at least partially received within the plate aperture, wherein the tube seal is forced downward by the plate against the top deck.

28. A personal watercraft as in claim 27, wherein the seal has a top having a top maximum dimension and a bottom having a maximum dimension, wherein the seal top maximum dimension is less than the seal bottom maximum dimension and wherein the plate aperture has a top opening smaller than an aperture bottom opening, such that at least part of the plate forces downwardly against at least part of the seal.

29. A personal watercraft as in claim 28, wherein the seal has a stepped transition between the seal top and the seal bottom.

30. A personal watercraft as in claim 27, wherein the top deck has a top deck aperture for receiving the tube, wherein the tube seal is forced downward by the hinge bottom portion against the top deck, wherein the tube extends through the top deck aperture, and wherein the seal is larger than the top deck aperture and resides above the top deck aperture.

31. A jet-propelled personal watercraft comprising:

a hull having a bottom hull and a top deck secured over the bottom hull, the hull defining an engine compartment sized to contain an internal combustion engine for powering a jet propulsion unit, the jet propulsion unit including a steerable water discharge nozzle, the top deck having a raised, longitudinally extending seat adapted to accommodate an operator in straddle fashion; and a plate assembly for mounting to the jet-propelled personal watercraft top deck, the plate assembly comprising: a plate for mounting to the top deck, the plate having a wireway aperture therethrough and a wire bundle assembly including a plurality of wires disposed within a tube disposed within a seal formed about the tube, and the tube seal being at least partially received within the plate aperture, wherein the seal is integrally formed about the wire tube.

32. A jet-propelled personal watercraft comprising:

a hull having a bottom hull and a top deck secured over the bottom hull, the hull defining an engine compartment sized to contain an internal combustion engine for powering a jet propulsion unit, the jet propulsion unit including a steerable water discharge nozzle, the top deck having a raised, longitudinally extending seat adapted to accommodate an operator in straddle fashion; and a plate assembly for mounting to the jet-propelled personal watercraft top deck, the plate assembly comprising: a plate fixedly secured against the top deck, the plate having a wireway aperture therethrough and a wire bundle assembly including a plurality of wires disposed within a tube disposed within a seal formed about the tube, and the tube seal being at least partially received within the plate aperture and contacting the top deck, wherein the seal has a top having a top maximum dimension and a bottom having a maximum dimension, wherein the seal top maximum dimension is less than the seal bottom maximum dimension and wherein the plate aperture has a top opening smaller than an aperture bottom opening, such that at least part of the plate forces downwardly against at least part of the seal.

* * * * *